US006148459A

United States Patent [19]

Verhulst

[11] Patent Number: 6,148,459

[45] Date of Patent: Nov. 21, 2000

[54] ORGANIZER

[75] Inventor: Roger C. Verhulst, Sidney, Nebr.

[73] Assignee: Cabela's Inc., Sidney, Nebr.

[21] Appl. No.: 09/124,390

[22] Filed: Jul. 29, 1998

[51] Int. Cl.[7] ..... A47C 21/00

[52] U.S. Cl. ..... 5/503.1; 5/110; 5/658; 248/311.2

[58] Field of Search ..... 5/110, 112, 503.1, 5/656, 119, 658; 108/28; 248/311.2; 224/156, 584, 922, 923

[56] References Cited

U.S. PATENT DOCUMENTS

| | | | |
|---|---|---|---|
| 325,879 | 9/1885 | Vuitton | 5/112 X |
| 3,717,188 | 2/1973 | Green | 224/42.11 |
| 4,235,350 | 11/1980 | Valentino | 5/503.1 X |
| 4,461,442 | 7/1984 | Keenan . | |
| 4,483,501 | 11/1984 | Eddy . | |
| 4,998,700 | 3/1991 | McKaig | 5/503.1 |
| 5,581,829 | 12/1996 | Lee | 5/503.1 |
| 5,651,152 | 7/1997 | Ritchie et al. . | |
| 5,732,914 | 3/1998 | Flinn . | |
| 5,758,972 | 1/1998 | Mack et al. . | |

*Primary Examiner*—Terry Lee Melius
*Assistant Examiner*—Fredrick Conley
*Attorney, Agent, or Firm*—Bachman & LaPointe, P.C.

[57] ABSTRACT

The present invention relates to a storage device or organizer for use with a cot/bed or some other support structure. The organizer has a main body formed from a flexible material and includes a pouch for storing an elongated article such as a fishing rod and reel or a rifle with a scope. It also includes a variety of pockets for storing personal items, a holder for a container such as a beverage container, an eyeglass holder, a flashlight holder and/or a pen holder. The organizer further includes a shelf. A plurality of straps may be provided for securing the organizer to the frame of a bed/cot or another support structure.

24 Claims, 4 Drawing Sheets

ORGANIZER

BACKGROUND OF THE INVENTION

The present invention relates to a storage device or organizer which can be used with a standard cot/bed.

In the pursuit of leisure activities, more and more people have turned to camping in the outdoors. Additionally, the number of individuals who hunt and/or fish continues to grow. One of the problems faced by both recreational campers and hunters/fishermen/fisherwomen is adequate storage for their personal items, particularly storage which allows their personal possessions to be readily accessible.

The problems faced by these individuals are not unlike those who have extended stays in hospital and need someplace to store their possessions. U.S. Pat. No. 5,651,152 to Ritchie et al., for example, illustrates a storage organizer for hospital patients which is removably attached to the bed rail of a hospital bed. The organizer is formed from a die curable, semi-rigid material such as corrugated plastic, thin vinyl, plastic coated corrugated paperboard or foam core board and has a number of compartments, including a lockable box, for storing objects.

Over the years, people have sought relaxation in bed. Here again, there has been a problem of where to put personal items when one wants to go to sleep. To provide these people with a place to store goods, a sundries caddy has been created which has a first portion which extends between the mattress and the box spring of a bed and a second portion which extends downwardly from the first portion along the side of the bed. The second portion contains one or more pockets for holding objects such books, magazines, and similar items. Such a sundries caddy is shown in U.S. Pat. No. 5,758,972 to Mack et al.

The rise in crime has caused a number of devices to be developed which allow a firearm to stored adjacent a bed. These kinds of devices are shown in U.S. Pat. No. 4,461,442 to Keenan, U.S. Pat. No. 4,483,501 to Eddy, and U.S. Pat. No. 5,732,914 to Flinn. Each of them has a first part which extends between the mattress and the box spring and a weapon holding device, such as a holster, connected to the first part.

No one has adequately addressed the needs of outdoors people who have a wide variety of items to be stored, have limited space in which to store them, and need them to be readily accessible. Thus, there remains a need for an organizer for holding or storing a wide variety of disparate goods.

SUMMARY OF THE INVENTION

Accordingly, it is an object of the present invention to provide an improved storage device.

It is a further object of the present invention to provide an improved storage device which has a plurality of compartments for storing a wide variety of items in a readily accessible manner.

It is yet a further object of the present invention to provide an improved storage device as above which may be readily stored when not in use or during travel.

It is still a further object of the present invention to provide an improved storage device as above which is easy to use and relatively inexpensive to produce.

The foregoing objects are attained by the storage device or organizer of the present invention.

In accordance with the present invention, a storage device or organizer for use with a cot/bed is provided. The organizer has a main body formed from a flexible material, which body includes a pouch for storing a weapon such as a rifle. It also includes a variety of pockets for storing personal items, a holder for a container such as a beverage container, an eyeglass holder, a flashlight holder and/or a pen holder. The organizer further includes a fold-down shelf for holding objects such as an alarm clock. Means for securing the organizer to the frame of a bed/cot or some other support structure are also provided.

Other details of the present invention, as well as other objects and advantages attendant thereto, are set forth in the following detailed description and the accompanying drawings in which like reference numerals depict like elements.

DETAILED DESCRIPTION OF THE PREFERRED EMBODIMENT(S)

Figure 1:
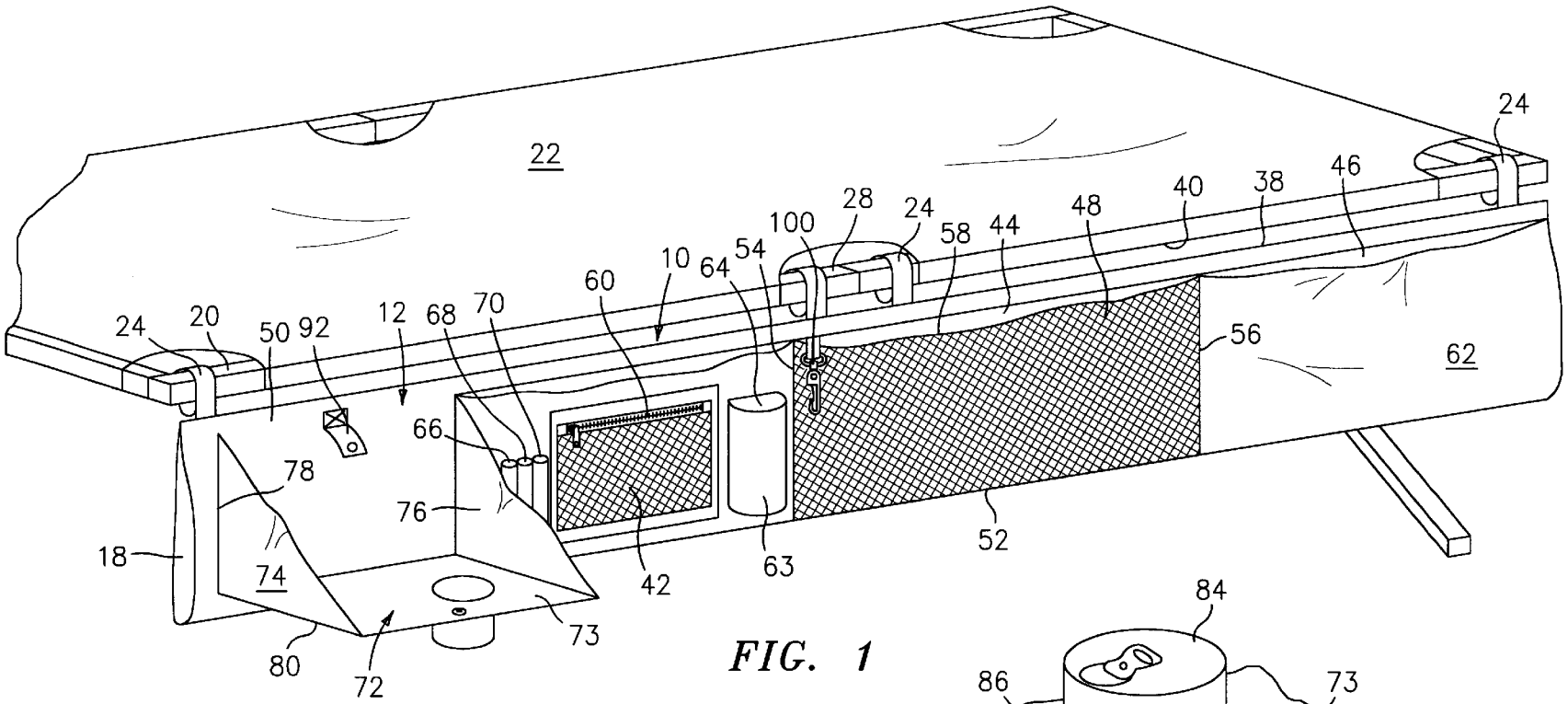
FIG. 1 is a perspective view of a storage device or organizer in accordance with the present invention.
Figure 2:
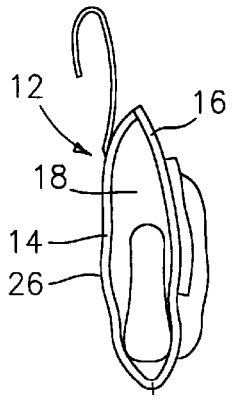
FIG. 2 is an end view of the device showing a firearm stored in a special boot.

Referring now to the drawings, FIG. 1 illustrates a storage device or organizer 10 in accordance with the present invention. The organizer 10 has a main body portion 12 formed from a flexible material such as nylon, polyester, ramie, and cotton canvas. The main body 12 may be formed from two pieces 14 and 16 of material joined together along their respective upper and lower edges as shown in FIG. 2. The pieces 14 and 16 can be joined together using any suitable technique known in the art such as being sewn together. Alternatively, the main body 12 may be formed from a single piece of flexible material which is looped around and joined together along one edge.

In a preferred embodiment of the present invention, the pieces 14 and 16 are joined together so as to form a pouch or a boot 18 for storing an elongated article such as a rifle with a scope or a fishing rod. The pouch 18 preferably extends the entire length of the organizer 10. If desired, the pieces 14 and 16 may be joined together in any desired manner so as to form more than one pouch or boot 18 for storing an elongated article.

Figure 4:
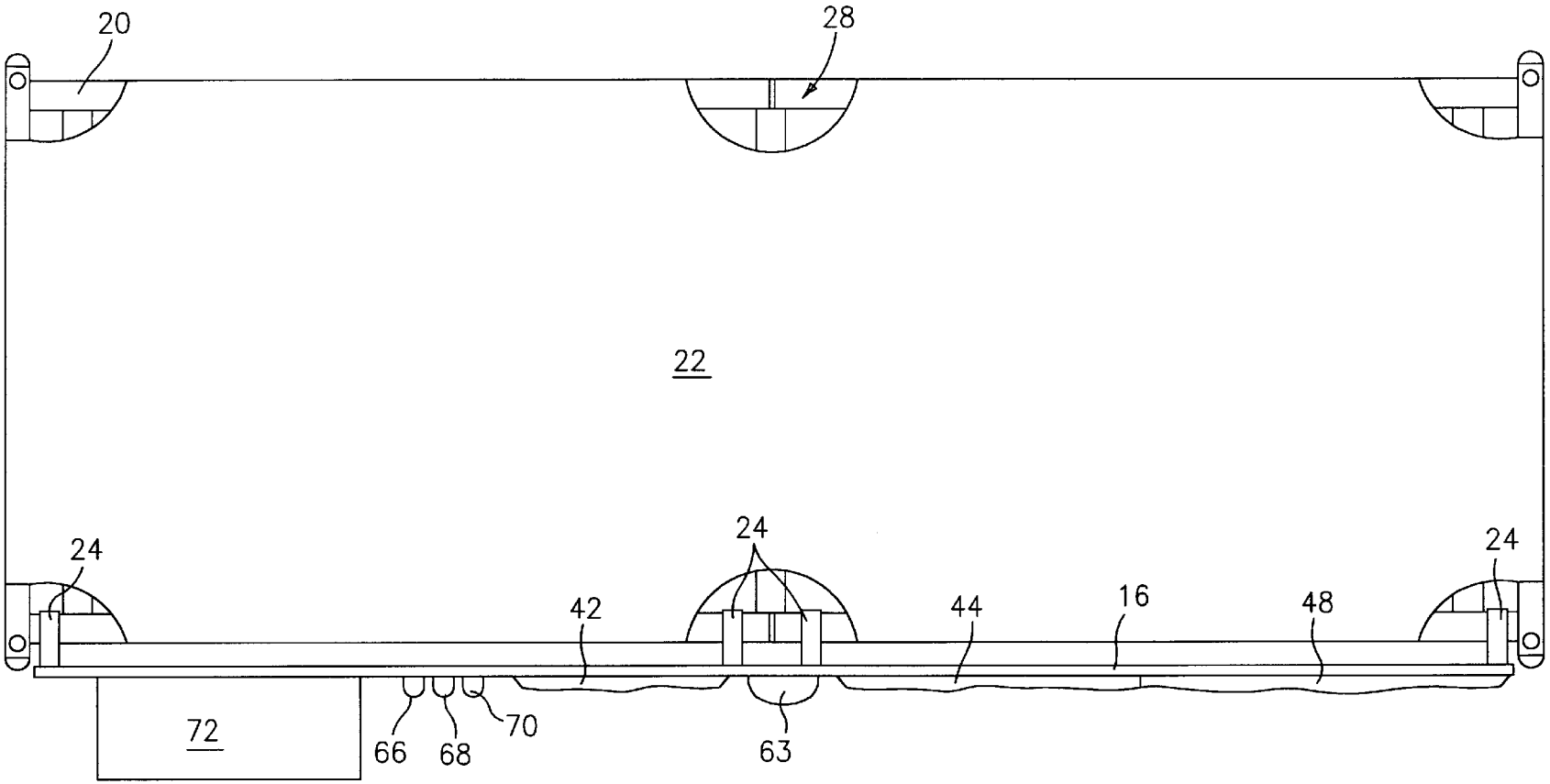
FIG. 4 is a top view of a cot having a storage device in accordance with the present invention.

As shown in FIGS. 1 and 4, the organizer 10 is intended to be mounted to a frame 20 of a cot/bed 22. To this end, a plurality of straps 24 are attached to the exterior surface 26 of the piece 14. The straps 24 may be attached to the exterior surface 26 using any suitable technique known in the art such as by sewing. Further, the straps 24 may be spaced so as to mate with exposed portions 28 of the frame 20, i.e.

portions of the frame that do not have any of the fabric forming the sleeping surface attached to them.

Figure 5:
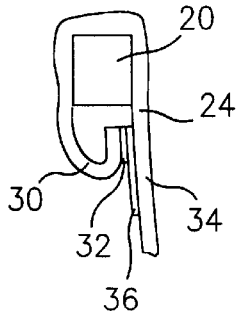
FIG. 5 is a sectional view taken along line 5—5.

As shown in FIG. 5, a first portion 30 of each strap 24 may have a hook fastening system 32 attached to it. The hook fastening system 32 may be attached to the first portion 30 by any suitable means known in the art such as by an adhesive or by sewing. Each strap 24 further has a second portion 34 with a loop fastening system 36 attached to it. The loop fastening system 36 may be attached to the second portion 34 in any desired manner known in the art such as by an adhesive or by sewing. If desired, the first portion 30 could have the loop fastening system 36 and the second portion 34 could have the hook fastening system 32.

When the cot organizer 10 is installed, each strap 24 loops around the frame 20 until the hook fastening system 32 abuts and mates with the loop fastening system 36. Preferably, each strap 24 has a length which allows the upper edge 38 of the organizer to be positioned just below the lower edge 40 of the frame 20.

The organizer 10, as shown in FIG. 1, includes a number of pockets 42, 44, and 46 for storing items such as toilet paper, wallets, tapes, CDs, clothing articles, playing cards, food products, medicines, toiletries, toothbrushes, shaving equipment, hunting supplies, fishing supplies, etc. Each of the pockets 42, 44 and 46 is preferably formed by an elastic material 48, such as an elastic mesh material or a nylon material, attached to an exterior surface 50 of the piece 16. Each piece of the mesh material 48 is preferably joined to the exterior surface 50 along a bottom edge 52 and the side edges 54 and 56. Preferably, the top edge 58 of the material 48 is reinforced by another material. If desired, a zipper 60 may be provided to allow the top of at least one of the pockets 42, 44 and 46 to be closed. While it is preferred to form each of the pockets 42, 44 and 46 out of mesh material so that a user can see the objects stored within the pocket, it is possible to form one or more of the pockets 42, 44 and 46 from a solid material such as a solid nylon material 62.

One of the pockets may be provided with a means 100 for holding keys. The key holding means 100 could be a strap attached to the exterior surface 50 having a hook arrangement at one end to which the keys can be attached.

The organizer 10 further includes a piece of flexible material 63 attached to the exterior surface 50 along its bottom and side edges so as to form an eyeglass holder 64. If desired, the interior surfaces of the material 63 may be lined with a soft material (not shown) so as to reduce the possibility of damaging any eyeglasses stored within this compartment.

Still further, the organizer 10 includes a plurality of pieces of flexible material attached to the exterior surface 50 so as to form a series of pockets 66, 68, and 70 for holding writing implements and/or a flashlight. As before, the pieces of flexible material may be joined to the exterior surface 50 along their bottom and side edges using any suitable technique known in the art such as by sewing.

Figure 7:
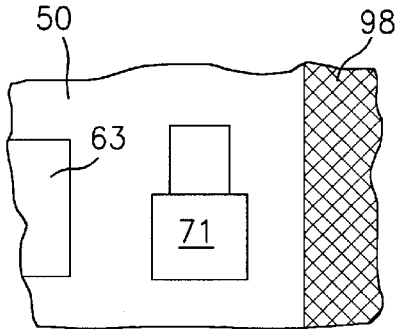
FIG. 7 is a view of a portion of a storage device in accordance with the present invention having a holder for a container.

As shown in FIG. 7, if desired, flexible material may be attached to the exterior surface 50 to form a pouch 71 for holding a container such as a beer can, a soda can, a water bottle, etc. Here again, the material may be joined to the exterior surface 50 using any suitable technique known in the art such as by sewing. In a preferred construction, the flexible material attached to the exterior surface includes a first piece for supporting the bottom of the container and a second piece for surrounding a portion of the container and thereby hold it in position.

The organizer 10 is provided with a fold down shelf 72. The fold down shelf 72 is preferably formed from a piece 73 of rigid material, such as ½" closed cell foam or plastic sheet, covered with a material such as a NYLON material. The shelf 72 is hingedly connected to the exterior surface 50 of the main body 12 so that it is movable between a stowed position where it is substantially parallel to the exterior surface 50 and a deployed position where it is substantially perpendicular to the exterior surface. The hinged connection between the shelf 72 and the exterior surface 50 may be formed in any desired manner known in the art. A piece of fabric 75 is preferably attached to the rigid material piece 73 and the exterior surface 50 such as by sewing. The fabric piece 75 preferably forms a pair of sidewalls 74 and 76 and a lip portion 77. The shelf 72 may be used for a variety of purposes such as to allow an alarm clock to be placed next to the bed frame. The sidewalls 74 and 76 and the lip portion 77 prevent items placed on the shelf from falling off.

Figure 3:
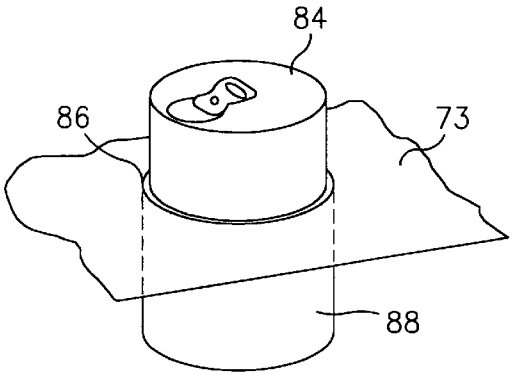
FIG. 3 is an enlarged view of an optional can/cup holder incorporated into the storage device.

Referring now to FIGS. 1 and 3, if desired, the shelf 72 may be provided with an optional means 82 for holding a container 84. The holding means 82 may comprise an orifice 86 in the shelf and a collapsible nylon cylinder 88 sewn onto the lower surface 90 of the shelf 72.

Figure 6:
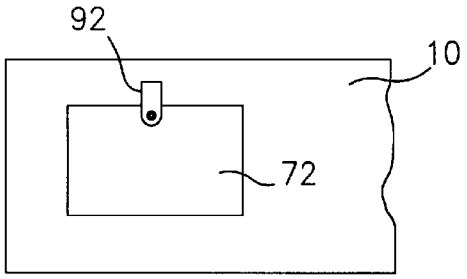
FIG. 6 is a partial view of the storage device of FIG. 1 showing the shelf in its stored position.

As shown in FIGS. 1 and 6, an optional snap closure system 92 may be provided to hold the shelf 72 in its stored or stowed position when not in use. While a snap closure system may be used to hold the shelf 72 in its stored position, other types of closure systems, such as a VELCRO system, could be used.

Figure 8:
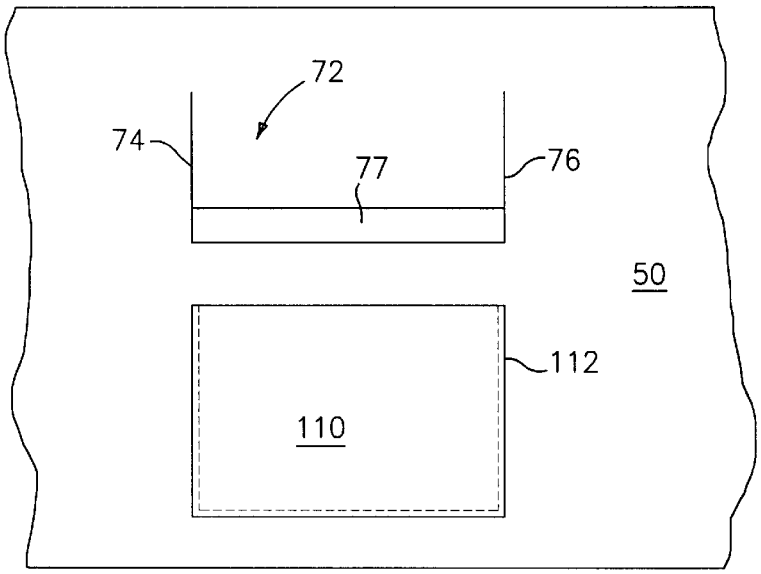
FIG. 8 is a view of a portion of the storage device of FIG. 1 having a storage pocket positioned beneath a shelf.

If desired, a storage pocket 110 may be provided beneath the shelf 72 as shown in FIG. 8. The storage pocket 110 may be formed by sewing or otherwise attaching a piece of fabric 112 to the exterior surface 50 of the main body.

If desired, two of the pockets 66, 68, and 70, may be replaced by a single pocket formed by sewing or otherwise attaching a piece of fabric to the exterior surface 50 of the main body 12.

Figure 9:
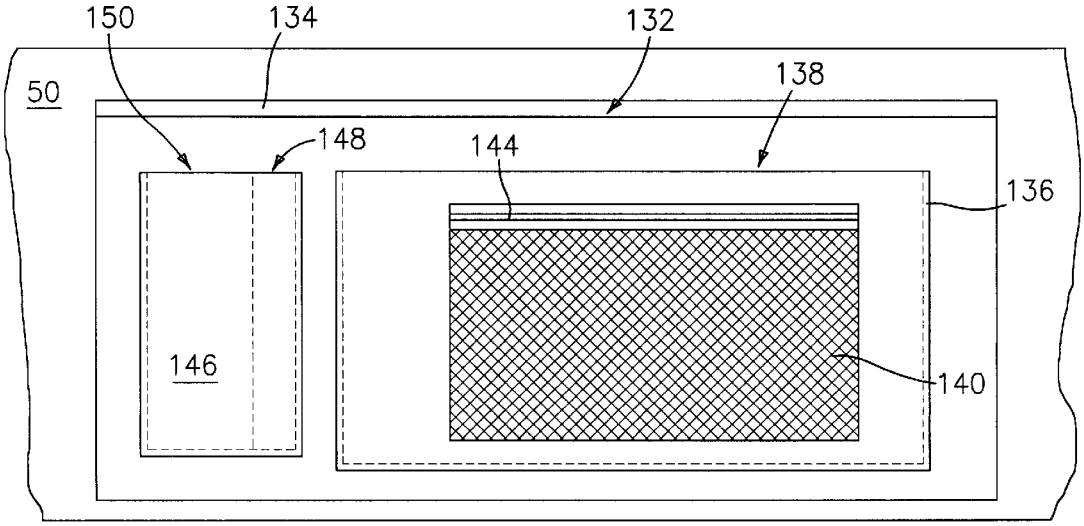
FIG. 9 is a view of a portion of the storage device of FIG. 1 illustrating an alternative configuration of the pockets and article holders.

Referring now to FIG. 9, it is possible to arrange certain of the storage compartments to have the configuration shown therein. For example, a piece of fabric 130 can be stitched to the exterior surface 50 of the main body 12 so as to form an elongated pocket 132. The pocket 132 may be provided with a slidable zipper 134 at its upper edge to close it. A second piece of fabric 136 may be stitched along its lower and side edges to an outer surface of the fabric piece 130 to form a pocket 138. Still further, a piece of mesh material 140 may be stitched or sewn to an outer surface of the fabric 136 to form a pocket 142. If desired, a zipper 144 can be provided to enable the pocket 142 to be sealed.

Yet another piece of fabric 146 can be sewn or stitched to the exterior surface of the fabric piece 132 so as to form a holder 148 for a pen, pencil or flashlight, and a storage pocket 150.

While each of the straps 24 has a hook and loop fastening system for attaching the organizer 10 to the frame of a bed or a cot, each strap could also be provided with a D-ring 152 and/or a flexible loop 154 to allow the organizer 10 to be affixed to a different type of support structure.

One of the principal advantages of the organizer of the present invention is its ability to provide storage for many different items used by outdoors people and for having such items readily accessible and visible to the user. Yet another advantage is the fact that the organizer is formed from lightweight material(s) and can be rolled up or folded into a compact arrangement for storage or travel. Still further, the organizer 10 of the present invention is relatively inexpensive to produce and easy to use.

While the organizer of the present invention may be used by outdoors people, such as hunters, campers, fishermen, and fisherwomen, it can also be used by ordinary people such as students. The straps 24 allow the organizer to be attached to a wide variety of support structures. For example, the organizer could be attached to the frame of a standard bed and used in homes, hotels, dormitories, and the like to store a user's goods. Still further, the organizer 10 could be attached to the frame of a baby crib and used to store baby care products. The wide variety of potential uses for the organizer of the present invention is due to its ability to hold a wide range of goods in a readily accessible manner. The organizer of the present invention also lends itself to a wide variety of potential uses because it can be made from a wide variety of aesthetically pleasing fabrics and materials.

While the cot organizer 10 has been described as having a loop fastening system 36, it is possible to omit the loop fastening system and to directly attach the cot organizer to the frame of the cot or bed via screws, plugs, adhesive and the like. For example, eyelets (not shown) could be formed in the main body portion along an upper edge through which screws and plugs could be inserted. In this manner, the organizer 10 could be permanently attached to the cot/bed or some other support structure.

While the organizer 10 has been described as being an item separate from the cot/bed, it is also possible to make the organizer part of the cot/bed. For example, the cot organizer 10 could be integrally formed with the cot itself such as by sewing the organizer 10 in as part of the cot/bed.

While specific arrangements of the pockets, shelf and article holders have been illustrated in the drawings, it should be apparent that other arrangements could be used. For example, the eyeglass holder can be positioned adjacent the holders for a pen and/or a flashlight. The present invention is intended to cover such alternative arrangements.

It is apparent that there has been provided in accordance with this invention an organizer which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An organizer comprising:

a flexible storage device having at least two compartments for storing personal items, said storage device being made from a non-rigid material;

means for securing said storage device to a horizontal frame of a sleeping unit so that said storage device is supported by said frame, whereby said storage device is adapted to be positioned beneath said frame;

said storage device having a main body and said at least two compartments including a pouch within said main body for receiving and storing an elongated article;

a shelf attached to said main body; and said shelf including a rigid portion connected to an exterior surface and further including sidewalls and a lip portion abutting said rigid portion, said sidewalls and said lip portion helping to prevent objects placed on said shelf from falling.

2. The organizer of claim 1 wherein said pouch is coextensive with said storage device and stores at least one of a fishing rod and a firearm.

3. The organizer of claim 1 wherein said storage device has a length and said securing means comprises a plurality of straps spaced along the length of said storage device.

4. The organizer of claim 3 wherein each of said straps has a hook fastening system attached to a first portion and a loop fastening system attached to a second portion so that when said strap is wrapped around said frame, said loop fastening system mates with said hook fastening system to secure said organizer in place.

5. The organizer of claim 1 wherein said shelf is movable between a stowed position where it is substantially parallel to said exterior surface of said main body and a deployed position where it is substantially perpendicular to said exterior surface.

6. The organizer of claim 1 wherein said sidewalls and said lip portion are formed from a flexible material attached to said rigid portion and to said exterior surface of said main body.

7. The organizer of claim 1 further including means for holding said shelf in said stowed position.

8. The organizer of claim 1 further comprising said shelf including means for holding a container.

9. The organizer of claim 1 wherein said at least two compartments further includes at least one piece of a mesh material affixed to said exterior surface of said main body so as to form at least one pocket for receiving items to be stored.

10. The organizer of claim 1 wherein said at least two compartments includes a pocket for holding eyeglasses attached to said exterior surface of said main body.

11. The organizer of claim 1 further comprising means for holding a pen attached to said exterior surface of said main body.

12. The organizer of claim 1 further comprising means for holding a beverage container attached to said exterior surface of said main body.

13. The organizer of claim 1 wherein said at least two compartments further include a piece of flexible material attached to an exterior surface of said main body and said piece of flexible material forming a pocket with said exterior surface.

14. The organizer of claim 13 wherein said piece of flexible fabric comprises a mesh material for allowing a user to see into the pocket.

15. The organizer of claim 13 wherein said piece of flexible fabric comprises a solid piece of a nylon material.

16. The organizer of claim 1 further comprising means for holding a flashlight attached to said exterior surface of said main body.

17. The organizer of claim 1 wherein said at least two compartments further include at least one zippered pocket attached to said exterior surface of said main body.

18. The organizer of claim 1 further comprising means for holding keys attached to said exterior surface of said main body.

19. The organizer of claim 1 further comprising said main body being formed by two pieces of flexible material joined together along two opposed edges.

20. The organizer of claim 1 further comprising said main body being formed by a single piece of flexible material having two opposed edges joined together.

21. The organizer of claim 1 wherein said sleeping unit comprises a cot having a horizontal frame for supporting a sleeping surface and said storage device is attached to said horizontal frame so that an upper edge of said storage device is positioned beneath a lower edge of said horizontal frame.

22. The organizer of claim 1 wherein said storage device may be rolled up when not in use.

23. The organizer of claim 1 wherein said securing means comprises means for permanently attaching said storage device to said frame.

24. The organizer of claim 1 wherein said storage device is an integral part of said sleeping unit.

* * * * *

UNITED STATES PATENT AND TRADEMARK OFFICE

CERTIFICATE OF CORRECTION

PATENT NO. : 6,148,459
DATED : November 21, 2000
INVENTOR(S) : ROGER C. VERHULST It is certified that error appears in the above-identified patent and that said Letters Patent is hereby corrected as shown below:

In Column 6, claim 7, line 14, "claim 1" should read --claim 5--.

In Column 6, claim 13, line 33, "an" should read --said--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*